US009285742B2

(12) United States Patent
Shida et al.

(10) Patent No.: US 9,285,742 B2
(45) Date of Patent: Mar. 15, 2016

(54) IMAGE FORMING APPARATUS TO ADJUST THE AMOUNT OF LIGHT EXPOSED BY AN EXPOSURE UNIT

(71) Applicant: CANON KABUSHIKI KAISHA, Tokyo (JP)

(72) Inventors: Tomonori Shida, Mishima (JP); Hiroshi Kita, Mishima (JP); Masatoshi Itoh, Mishima (JP); Hiroshi Hagiwara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/316,307

(22) Filed: Jun. 26, 2014

(65) Prior Publication Data

US 2015/0002597 A1 Jan. 1, 2015

(30) Foreign Application Priority Data

Jun. 28, 2013 (JP) ..... 2013-137039

(51) Int. Cl.

*B41J 2/47* (2006.01)
*G03G 15/00* (2006.01)
*G03G 15/043* (2006.01)

(52) U.S. Cl.

CPC ..... *G03G 15/5058* (2013.01); *G03G 15/043* (2013.01); *G03G 2215/0129* (2013.01)

(58) Field of Classification Search

USPC ..... 347/131, 135, 188, 236, 237, 240, 246, 347/247, 251, 253; 399/41, 49, 51, 72

See application file for complete search history.

(56) References Cited

U.S. PATENT DOCUMENTS

| | | | | |
|---|---|---|---|---|
| 7,675,532 | B2 * | 3/2010 | Iida et al. | 347/132 |
| 7,715,741 | B2 * | 5/2010 | Yamamoto | 399/49 |
| 8,587,627 | B2 * | 11/2013 | Takahashi et al. | 347/234 |
| 2011/0228355 | A1 * | 9/2011 | Morita et al. | 358/475 |

FOREIGN PATENT DOCUMENTS

| | | | |
|---|---|---|---|
| JP | 2005-215295 | A | 8/2005 |
| JP | 2006-349851 | A | 12/2006 |
| JP | 2009-098626 | A | 5/2009 |
| JP | 2011-215582 | A | 10/2011 |

* cited by examiner

*Primary Examiner* — Hai C Pham

(74) *Attorney, Agent, or Firm* — Canon USA, Inc. IP Division

(57) ABSTRACT

Included is an image bearing member; an exposure unit configured to form electrostatic latent images by scanning light on the image bearing member and to change the amount of light along the scanning direction of the light; a forming unit configured to form a toner patch on the basis of the electrostatic latent image formed by a plurality of different light amounts, to adjust the light amount of the exposure unit; a detection unit configured to detect the toner patch; and a control unit configured to adjust the light amount of the exposure unit along the scanning direction of the light depending on the detection result by the detection unit. The control unit changes the light amount of the exposure unit along the scanning direction of the light over a portion of regions rather than all regions in the scanning direction when forming the toner patch.

22 Claims, 12 Drawing Sheets

IMAGE FORMING APPARATUS TO ADJUST THE AMOUNT OF LIGHT EXPOSED BY AN EXPOSURE UNIT

BACKGROUND OF THE INVENTION

1. Field of the Invention

The present invention is related to an image forming apparatus configured to adjust the amount of light exposed by an exposure unit.

2. Description of the Related Art

An image forming apparatus according to the related art using the electrophotographic method forms an electrostatic latent image on a photosensitive drum by exposing light onto the photosensitive drum serving as an image bearing member by an exposure unit. The image is formed by transferring developer (toner image) formed on the photosensitive drum by developing the electrostatic latent image to a sheet of paper as the recording medium. The light source serving as the exposure unit can be a laser, light-emitting diode (LED), or other light source.

According to such an image forming apparatus, uneven density occurs in the developer formed on the photosensitive drum when the laser scans in the main scanning direction (longitudinal direction of the photosensitive drum). Examples of uneven density include uneven exposure amounts, unevenness in the sensitivity of the photosensitive drum, differences in the charge amount of the developer, and other like unevenness due to the developing unit. To reduce this uneven density, Japanese Unexamined Patent Application Publication No. 2009-98626 proposes an invention to form toner patches for detecting uneven density, and adjusting the maximum exposure amount profile for the laser in the main scanning direction on the basis of the result of detecting the uneven density levels of the toner patch. In this case, the maximum exposure amount of the laser is the amount of light used when forming an image at a uneven density level of 100% (solid image). By adjusting the maximum exposure amount, uneven density can be reduced, including halftones in the main scanning direction. Adjustments to the maximum exposure amount of the laser are performed by dividing the laser scanning region of the main scanning direction into multiple smaller regions, and adjusting the maximum exposure amount for each of the divided scanning regions.

According to the related art, uneven density is reduced by dividing the laser scanning region for the main scanning direction into multiple smaller regions, and adjusting the maximum exposure amount. In this case, by increasing the number of the divided scanning regions, uneven density can be further reduced as the maximum exposure amount can be adjusted more finely.

However, by dividing the laser scanning region into multiple smaller regions, time is required to change the maximum exposure amount profile of each scanning region. The adjustments of the laser maximum exposure amount are performed sequentially for each region, and so the time required for changing increases as the amount of scanning regions increase. As a result, this creates a problem in which downtime required for forming toner patches for detecting uneven density, and performing recalibration to adjust the maximum exposure amount profiles in the main scanning direction on the basis of the results of detecting uneven density levels of the toner patches increases.

SUMMARY OF THE INVENTION

It has been found desirable to reduce the downtime required for recalibration to adjust the maximum exposure amount in the main scanning direction.

An image forming apparatus according to an aspect of the present invention includes: an image bearing member; an exposure unit configured to form electrostatic latent images by scanning light on the image bearing member and to change the amount of light along the scanning direction of the light; a forming unit configured to form a toner patch on the basis of the electrostatic latent image formed by a plurality of different light amounts, to adjust the light amount of the exposure unit; a detection unit configured to detect the toner patch; and a control unit configured to adjust the light amount of the exposure unit along the scanning direction of the light depending on the detection result by the detection unit. The control unit changes the light amount of the exposure unit along the scanning direction of the light over a portion of regions rather than all regions in the scanning direction when forming the toner patch.

Further features of the present invention will become apparent from the following description of exemplary embodiments with reference to the attached drawings.

DESCRIPTION OF THE EMBODIMENTS

Hereafter, the embodiments of the present invention will be described with reference to the drawings. The following embodiments do not limit the scope of the present invention, and all combinations of the features described by the embodiments are not necessarily required.

First Embodiment

Description of the Image Forming Apparatus

Figure 1:
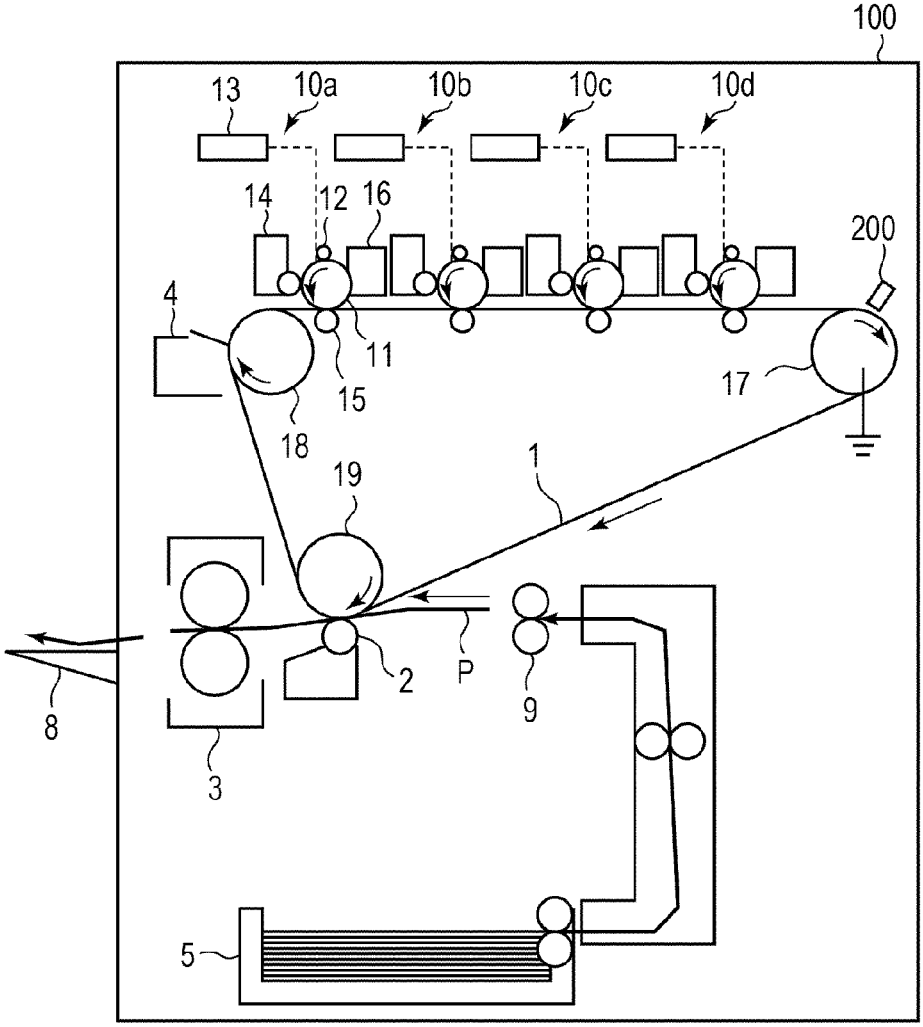
FIG. 1 is a schematic configuration diagram of an image forming apparatus.

FIG. 1 is a schematic configuration diagram of an image forming apparatus. The image forming apparatus is implemented, for example, as a printer, copier, multifunction device, or fax machine. An image forming apparatus 100 according to the present embodiment is a full-color printer using an intermediate transfer system including four image bearing members. Included are image forming stations 10*a* through 10*d* corresponding to yellow (Y), magenta (M), cyan (C), and black (K). Also included is an intermediate transfer belt 1 as an intermediate transfer body and a fixing device (fixing unit) 3. The image forming stations 10*a* through 10*d* are unitized as image forming units. The image forming stations 10*a* through 10*d* each have common configurations, and so hereinafter, the description will focus on the image forming station 10*a*.

A photosensitive drum 11 in the image forming station 10*a* is provisioned with an aluminum cylinder body and a photoelectric layer formed on the surface of the body. As the photosensitive drum 11 rotates in the direction indicated by the arrow, a charging roller 12 charges the surface with a uniform negative charge (for example, charge voltage VD=−500 V). When laser exposure modulated in accordance with an image signal is performed by a laser exposure unit 13, at a position downstream from the charging roller 12 regarding the rotational direction of the photosensitive drum (for example, solid image exposure voltage VL=−100 V), the surface of the photosensitive drum 11 forms an electrostatic latent image corresponding to the yellow image components.

The electrostatic latent image formed on the photosensitive drum 11 is developed using the yellow toner given a negative charge by a developing unit 14 regarding the downstream side of the laser exposure unit 13, which is visible as a yellow toner image (reversal development). The toner is, for example, non-magnetic one-component toner having a negative charge. The primary transfer of the yellow toner image formed on the photosensitive drum 11 onto the intermediate transfer belt 1 is performed by a primary transfer roller 15. After the primary transfer, the remaining toner on the surface of the photosensitive drum 11 is cleaned by a drum cleaner 16.

The aforementioned image forming operation is executed at a predetermined timing regarding each of the image forming stations 10*a* through 10*d*, and the primary transfer of the toner image formed on each photosensitive drum 11 is sequentially transferred to the intermediate transfer belt 1. Afterwards, as rotation continues in the direction indicated by the arrow for the intermediate transfer belt 1, the toner image transferred with multiple layers on the intermediate transfer belt 1 transitions to a secondary transfer unit configured with a secondary transfer roller 2 and a secondary transfer counter roller 19. Paper is fed from a paper feed tray 5, which is conveyed to the secondary transfer unit by a conveyor roller 9 at a predetermined timing where the secondary transfer of the toner image is transferred onto the paper as the recording medium. The recording medium onto which the secondary transfer of the toner image is transferred is conveyed to the fixing unit 3, which fixes the image by heat and pressure. The recording medium onto which the image has been fixed by the fixing unit 3 is discharged to a discharge tray 8.

The intermediate transfer belt 1 is tensioned by three rollers, a drive roller 17, a tension roller 18, and the secondary transfer counter roller 19 to be rotationally driven by the drive roller 17 in the direction indicated by the arrow in the figure. The intermediate transfer belt 1 is arranged to make contact with the photosensitive drum 11 provisioned to each of the image forming stations 10*a* through 10*d*. A belt cleaner 4 is arranged to clean toner remaining on the surface of the intermediate transfer belt 1 after the secondary transfer. A sensor 200 is arranged at the position opposite of the drive roller 17. The sensor 200 detects images for adjusting the maximum exposure amount (hereinafter, also referred to as toner patches) formed on the intermediate transfer belt 1 to adjust the maximum exposure amount.

Description of the Sensor

Figure 2:
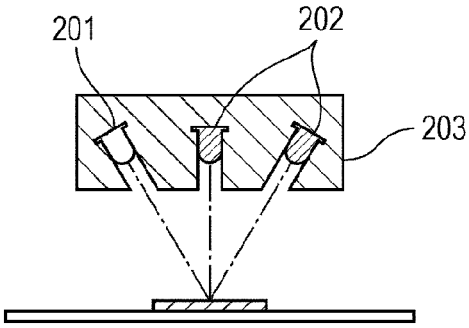
FIG. 2 is a schematic configuration diagram of a sensor configuration performing detection of toner patches.

FIG. 2 is a schematic configuration diagram of a sensor configuration performing detection of toner patches. The sensor 200 is provisioned with an LED 201 as a light-emitting element, a photodiode 202 as a light-receiving element, and a holder 203 to hold the light-emitting element and the light-receiving element. Light is irradiated from the LED 201 onto toner patches formed on the intermediate transfer belt 1, and the uneven density level of the toner patch is measured by the reflected and deflected light from the toner patch received by the photodiode 201.

The sensor 200 according to the present embodiment is arranged as a group of three sensors disposed along the main scanning direction (direction perpendicular to the direction of movement of the intermediate transfer belt 1). As a specific example, they are arranged at the center position of the main scanning direction and at positions ±130 mm from the center position regarding the range in which the toner image is formed. The sensors arranged at both ends are used to detect color shift control patterns. The sensor arranged in the center is used to detect uneven density level control patterns. The sensors arranged at the center and at both ends are used to detect toner patches.

The example given here arranges three sensors, but the present invention is not limited thusly, and any number of sensors, as long as at least two, can be arranged. The configuration exemplified here also uses a dome type LED in the sensors, but the present invention is not limited thusly, and the sensors can be configured with chip-type LEDs or similar.

Description of the Developing Unit

Figure 3:
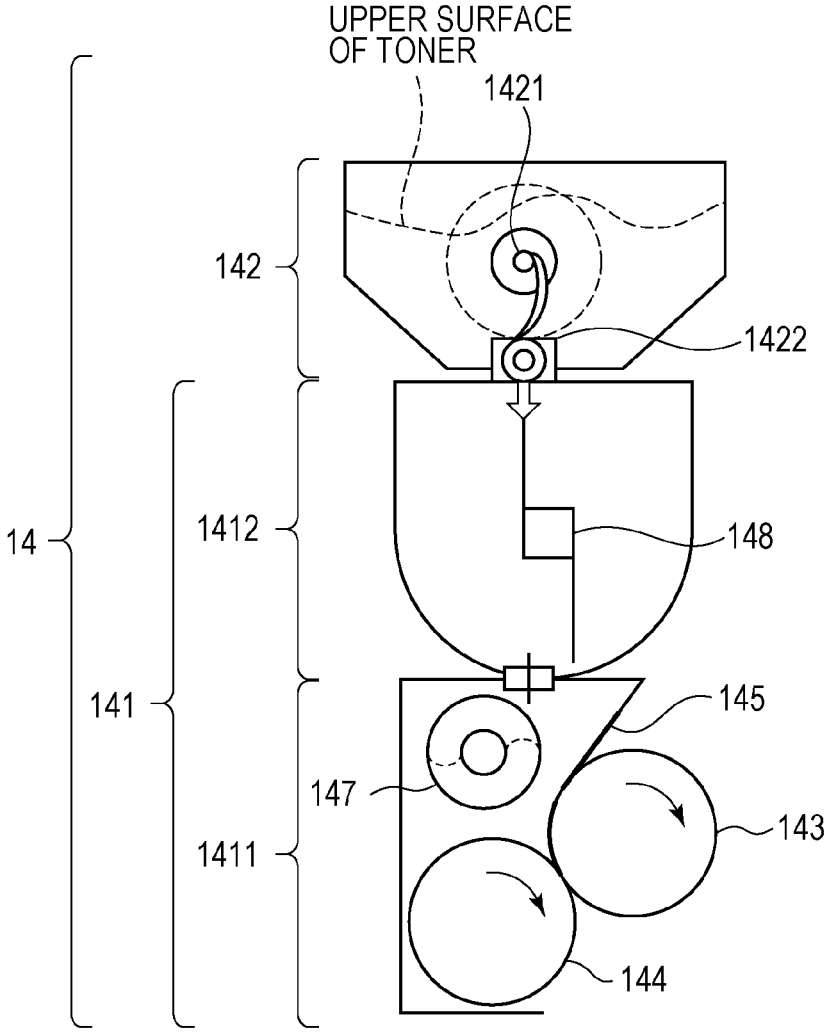
FIG. 3 is a schematic configuration diagram of a developing unit.

FIG. 3 is a schematic configuration diagram of the developing unit 14. The developing unit 14 provisioned to each image forming station has a similar configuration even though the color of the stored developer is different. Hereafter, the developing unit 14 will be described in detail.

The developing unit 14 is provisioned with the developer container 141 and a toner hopper 142. The toner hopper 142 supplies the developer container 141 with a predetermined amount of toner when it receives a developer supply instruction from the main unit of the image forming apparatus 100 so that the developer container 141 holds a constant amount of toner. A developer roller 143 is supported by the developer container 141 so as to be rotatable, and borders the photosensitive drum 11. A supply roller 144 includes an elastic body and supplies toner to the developer roller 143 as well as recovers toner from the developer roller 143.

A developer blade 145 as a toner layer regulating member is provisioned to the developer container 141, and abuts to the developer roller 143 by a predetermined contact pressure. The thickness of the toner layer supplied to the developer roller 143 and the rotation of the developer roller 143 is restricted by the developer blade 145. In this case, the toner is given a negative charge by triboelectric charging. The thin layer of toner formed on the circumferential surface of the developer roller 143 is supplied to the developer region where the developer roller 143 and the photosensitive drum 11 make contact, where the electrostatic latent image formed on the photosensitive drum 11 is developed. After passing the developer region, the toner remaining on the developer roller is returned from the circumferential surface of the developer roller 143 to the interior of the developer container 141 by the supply roller 144. Conversely, the toner remaining on the circumferential surface of the developer roller 143 is supplied again to the developer region together with toner newly supplied by the supply roller 144.

Figure 4:
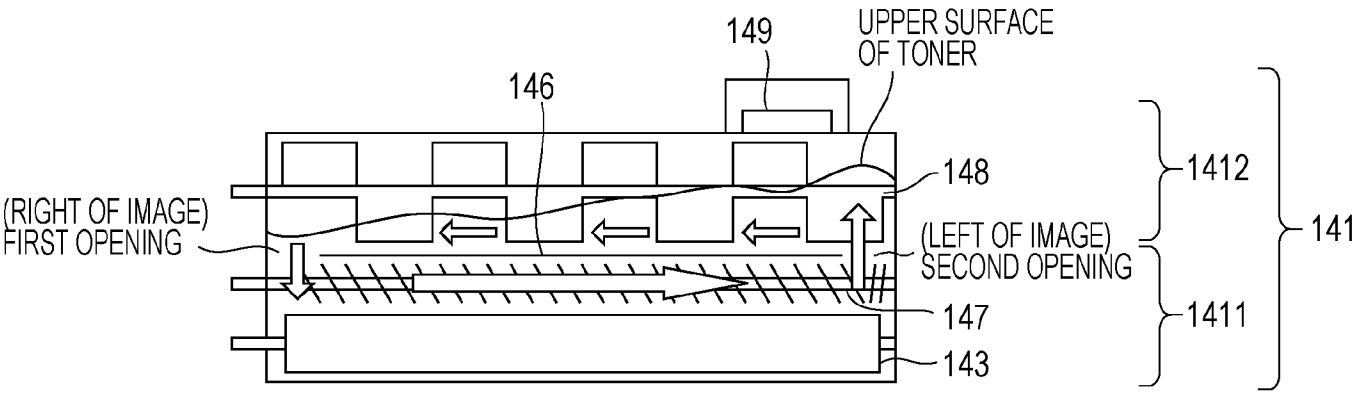
FIG. 4 is a schematic cross-sectional diagram in the longitudinal direction of a developer container.

FIG. 4 is a schematic cross-sectional diagram in the longitudinal direction of the developer container 141. The developer container 141 is divided into an upper and lower compartment (first compartment and second compartment) by a partition wall 146 longitudinally to the developer container 141. A developer unit 1411 as the first compartment includes the developer roller 143 and a screw 147 as a toner conveying member. This developer unit 1411 stores toner to be supplied to the developer roller 143.

A stirring unit 1412 as the second compartment includes a stirring member 148. The stirring unit 1412 temporarily stores toner supplied from the toner hopper 142 before supplying to the developer unit 1411. The developer unit 1411 and the stirring unit 1412 are connected by openings provisioned at both ends of the developer roller 143 longitudinally. That is to say, the developer unit 1411 and the stirring unit 1412 are connected at both ends of the developer roller 143 longitudinally.

The screw 147 in the developer unit 1411 conveys toner in the developer unit 1411 longitudinally. That is to say, the screw 147 sends toner supplied from a first opening toward the middle of the developer unit 1411 in the longitudinal direction, to a second opening. Toner is pushed up and out from the second opening by the stirring unit 1412. The screw 147 supplies toner to the developer roller 143 regarding the interior of the developer unit 1411 by this process. Conversely, the stirring member 148 in the stirring unit 1412 includes multiple blades to stir toner by rotation of these blades. The functions of the screw 147 and the stirring member 148 enable toner to be sufficiently mixed in the developer container 141 while circulating in the direction indicated by the arrows in FIG. 4.

Distribution of Toner Charge Amounts

Toner constantly circulates in the developer container 141 by repeatedly supplying toner to the developer roller 143 and removing toner from the developer roller 143. In this case, degraded toner with deteriorated charge characteristics mixes with new toner with charge characteristics that have not yet deteriorated just supplied from the toner hopper 142. The deteriorated toner and the new toner have different charge characteristics, and so the amount of charge (absolute value) applied by triboelectric charging when supplied to the developer roller 143 has a tendency to be smaller for the deteriorated toner and larger for the new toner.

These toners are circulated in a sufficiently mixed state by the stirring operation of the screw 147 and the stirring member 148 in the developer container 141. However, a characteristic distribution of the toner layer in the longitudinal direction forms on the developer roller 143 during the process to supply toner to the developer roller 143 while conveying developer unit along the developer roller 143 longitudinally. That is to say, when toner is conveyed from the first opening to the second opening, the new toner with a large charge amount preferentially forms a layer on the upstream side of the toner conveyor direction (first opening) of the developer roller 143. The deteriorated toner with a small charge amount does not form a layer on the upstream side when conveyed, and instead forms a layer on the downstream side of the toner conveyor direction (second opening). As a result, the toner layer formed on the developer roller 143 is distributed having a large negative charge amount on the upstream side of the toner conveyor direction in which the negative charge amount gradually lessens toward the downstream side of the toner conveyor direction.

Figure 5:
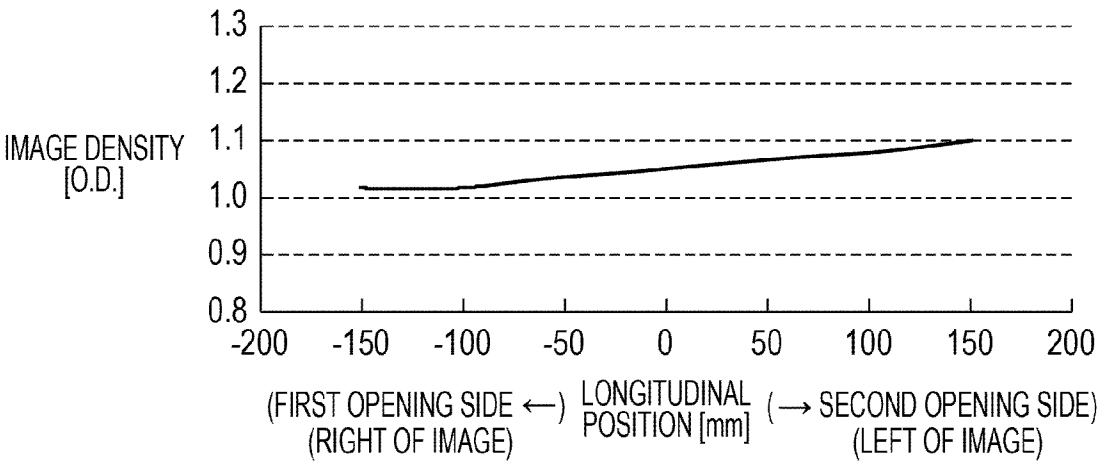
FIG. 5 is a diagram illustrating a distribution of uneven density.

If the toner negative charge amount is large, the amount of toner transitioned by the difference in voltages between the exposure voltage and the developer voltage decreases, and if the toner negative charge amount is small, the amount of toner transitioned by this same difference in potential is relatively large. That is to say, regarding the upstream side of the toner conveyor direction of the developer roller 143 which has toner with a large negative charge amount, the amount of toner developed onto the photosensitive drum 11 is relatively small, which reduces the uneven density level of the image on the recording medium. Conversely, regarding the downstream side of the toner conveyor direction of the developer roller 143 which has toner with a small negative charge amount, the amount of toner developed onto the photosensitive drum 11 is relatively large, which increases the uneven density level of the image on the recording medium. In this way, uneven density (gradient) occurs in the longitudinal direction of the developer roller 143. FIG. 5 is a diagram illustrating a distribution of the uneven density. As a method to correct this kind of uneven density and according to the present embodiment, the depth of the electrostatic latent image is adjusted by adjusting the maximum exposure amount (amount of light emitted) by the laser exposure unit 13 to form a gradient in the longitudinal direction of the photosensitive drum 11 corresponding to the longitudinal direction of the developer roller 143. Hereafter, this adjustment method will be described in detail.

Laser Exposure Unit 13

Figure 6:
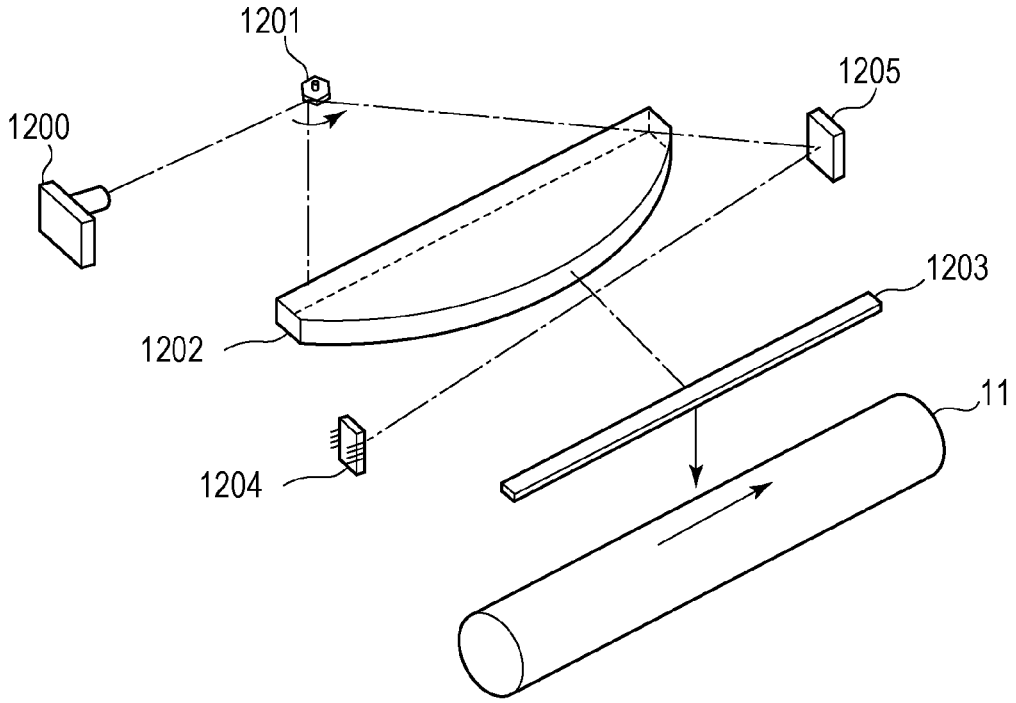
FIG. 6 is a diagram illustrating a configuration of a laser exposure unit.

The laser exposure unit 13 will now be described in detail. FIG. 6 is a diagram illustrating a configuration of the laser exposure unit 13. A semiconductor laser (hereinafter, also referred to as a laser) 1200 is an example of a light source. The laser 1200 functions as a laser light emitting unit irradiating a beam of light (laser beam) by control signals from an engine controller or video signals from a video controller (not illustrated). A polygon mirror 1201 is an example of a rotating polygon mirror. The polygon mirror 1201 rotates in the direction indicated by the arrows in the figure by a motor not illustrated, and scans the photosensitive drum 11 in the direction indicated by the arrow by reflecting the beam from the laser 1200. A lens 1202 is an optical component for scanning the beam on the photosensitive drum 11 at a constant speed.

Figure 7:
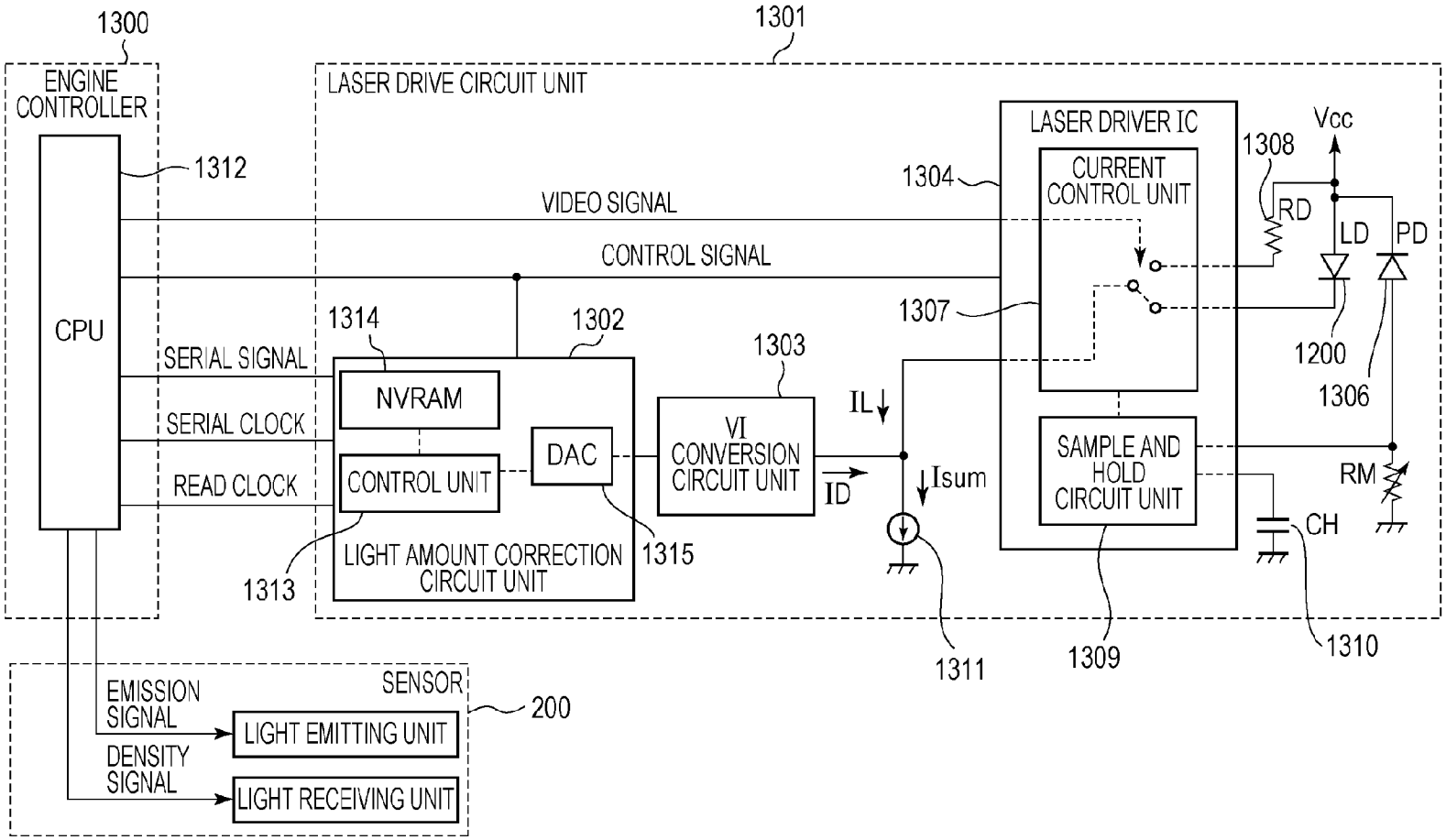
FIG. 7 is a block diagram illustrating a control of an image forming apparatus.

FIG. 7 is a block diagram illustrating a control of the image forming apparatus 100. An engine controller 1300 is a control unit including a central processing unit (CPU) 1312. A laser drive circuit unit 1301 is made from a light amount correction circuit unit 1302, a voltage/current (VI) conversion circuit unit 1303, a laser driver IC 1304, the laser 1200, and a photodiode 1306. The sensor 200 is connected to the CPU 1312, and detection results detected by the sensor 200 are sent to the CPU 1312. The CPU 1312 performs various calculations on these results. A current control unit 1307 in the laser driver IC 1304 controls the switching of lighting the laser 1200 by sending current in accordance with a video signal and turning off the laser 1200 by sending current to a dummy resistor 1308.

Next, sampling control will now be described in detail. The sampling control is performed when the laser exposure unit 13 starts up and for each scan when forming an image. When light emitted from the laser 1200 is received by the photodiode 1306, current is output in accordance with the amount of light emitted. The output current is input into a sample and hold circuit unit 1309, sampled, and output to the electric current control unit 1307. The electric current control unit 1307 compares the output signal from the sample and hold circuit unit 1309 with the necessary amount of light. When the output signal (amount of light emitted by the laser 1200) is weaker than the necessary amount of light, the drive current to the laser 1200 is increased. Conversely, when the output signal (amount of light emitted by the laser 1200) is stronger than the necessary amount of light, the drive current to the laser 1200 is decreased. Once the amount of light emitted reaches a predetermined amount of light, this is held by the sample and hold circuit unit 1309. By holding this output value in a capacitor 1310 connected to the sample and hold circuit unit 1309 as a voltage value, the laser 1200 can emit a predetermined amount of light at every scan.

A current Isum flowing through a constant current circuit unit 1311 is set by the VI conversion circuit unit 1303 so that the amount of light detected by the photodiode 1306 is a predetermined amount of light. The control unit 1313 of the light correction circuit unit 1302 is connected to the CPU 1312 of the engine controller 1300 by serial communication. The CPU 1312 of the engine controller 1300 sends information such as print modes to the control unit 1313 of the light correction circuit unit 1302.

The light correction circuit unit 1302 includes an NVRAM 1314, which is a nonvolatile storage unit, storing light amount correction profiles for the laser 1200. The correction profiles store current correction values for the laser 1200 regarding each scan position (divided scan regions). After synchronizing with a BD signal and a predetermined time elapses from the input of the control signal from the CPU 1312, the control unit 1313 of the light correction circuit unit 1302 starts to read the current correction values in the light amount correction profiles stored in the NVRAM 1314. This read timing is synchronized with a read clock signal output from the CPU 1312 of the engine controller 1300 determined in accordance with the number of divisions of the beam scanning length.

The control unit 1313 of the light correction circuit unit 1302 converts current correction value read from the light amount correction profile into a predetermined analog voltage value by a DA converter 1315 built into the light correction circuit unit 1302. The analog voltage value output from the light correction circuit unit 1302 is converted into a corrected current ID in the VI conversion circuit unit 1303, which then flows into the constant current circuit unit 1311. Thus, a laser current IL is obtained by subtracting the corrected current ID output from the light correction circuit unit 1302 from the current Isum flowing in the constant current circuit unit 1311. That is to say, the expression $$IL = Isum - ID \quad (1)$$

yields the laser current IL.

Method to Adjust the Maximum Exposure Amount

Figure 8:
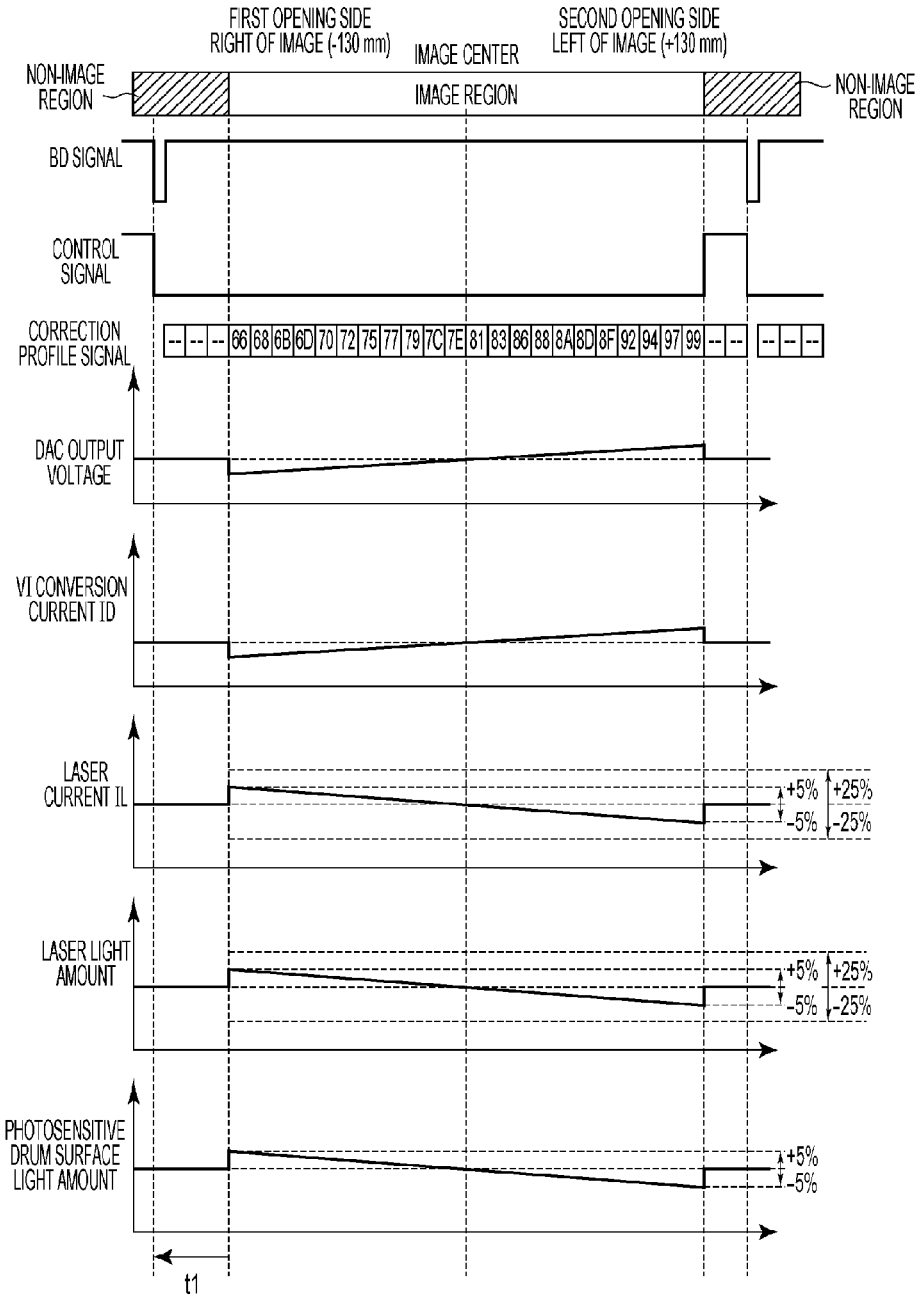
FIG. 8 is a diagram illustrating a method to adjust the maximum exposure amount.

FIG. 8 is a diagram illustrating a method to adjust the maximum exposure amount for the image region. According to the present embodiment, the example given divides the scanning region into 200 regions in the main scanning direction. The maximum exposure amount can be adjusted for each of the 200 scanning regions divided in the main scanning direction, but for the sake of clarity, a smaller number of scanning regions is illustrated in the figure. As the example given here, regarding the position in the center of the image, the data value is increased linearly by 5% for the right edge position of the image, and decreased by 5% for the left edge position of the image to create a light amount correction profile providing a total exposure difference of 10% left and right. In addition the amount of light for each address is set to be changeable by a maximum of ±25%. That is to say, FFh of the light amount correction profile data represents the corrected current ID as Isum+25%, and 00 h represents the corrected current ID as Isum−25%. 80 h represents the corrected current ID as 0 mA, or IL=Isum.

In FIG. 8, the right edge position of the image in the light amount correction profile data is 66 h, which represents that the corrected current ID is Isum−5%. As a result, the laser current IL becomes 105% of the Isum. Conversely, the left edge position of the image in the light amount correction profile data is 99 h, which represents that the corrected current ID is Isum+5%. As a result, the laser current IL becomes 95% of the Isum. Thus, the exposure after correction can have an exposure difference of 10% left and right regarding the exposure before correction. This light amount correction profile data is stored in the NVRAM 1314 of the light correction circuit unit 1302.

In this case, the example given for left and right gradient is 10%, the gradient can be set as desired to control uneven density in accordance with changes in image uneven density levels due to changes in charge characteristics or developer characteristics. In this case, the light amount correction profile is created to change the exposure linearly with regard to the distance of the main scanning direction, but the present invention is not limited thusly, and the light amount correction profile can be set as desired by changing the multiple, divided scanning regions to the same maximum exposure amount, and so on. By correcting such a light amount profile, the left and right difference in uneven density levels on an A4-landscape plain paper sheet is improved from a maximum of around 0.3 to a maximum of around 0.2.

Adjusting the Maximum Exposure Amount Using Toner Patches

In addition to this kind of maximum exposure amount adjustment, according to the present embodiment, the maximum exposure amount is further adjusted by using toner patches after correcting the maximum exposure amount profile for the multiple, divided scanning regions. By using toner patches, image uneven density levels are controlled to maintain suitable image uneven density levels even with wear of the photosensitive drum 11 from the effects of exposure changes and the progression of time, and changes in the charge characteristics of toner due to the effects of changes in the environment and so on. Generally, the image uneven density level control adjusts the maximum exposure amount or a developer voltage Vdev applied to the developer roller 143. As a result, the difference in voltage between the developer voltage Vdev and the exposure voltage VL, and the difference in voltage between the developer voltage Vdev and the charge voltage VD can be optimized in accordance with each environment or the state of the toner. According to the present embodiment, a method to adjust the maximum exposure amount is described, but the image uneven density levels can also be controlled as combination of adjusting the developer voltage and the maximum exposure amount.

Figure 9:
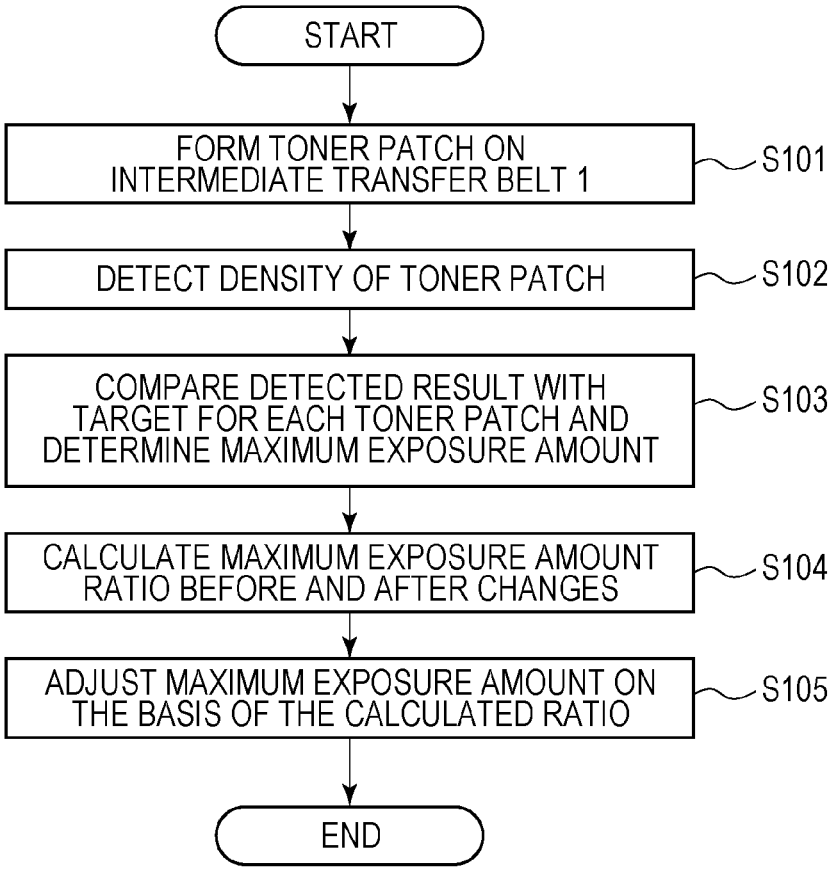
FIG. 9 is a flowchart describing the adjustment of the maximum exposure amount using toner patches.

FIG. 9 is a flowchart describing the adjustment of the maximum exposure amount using toner patches. According to the present embodiment, a toner patch including patterns formed at multiple uneven density levels is formed while changing the maximum exposure amount in multiple levels, and the maximum exposure amount is adjusted by detecting the toner patch with a sensor positioned at the longitudinal center of the image forming range.

Figure 10:
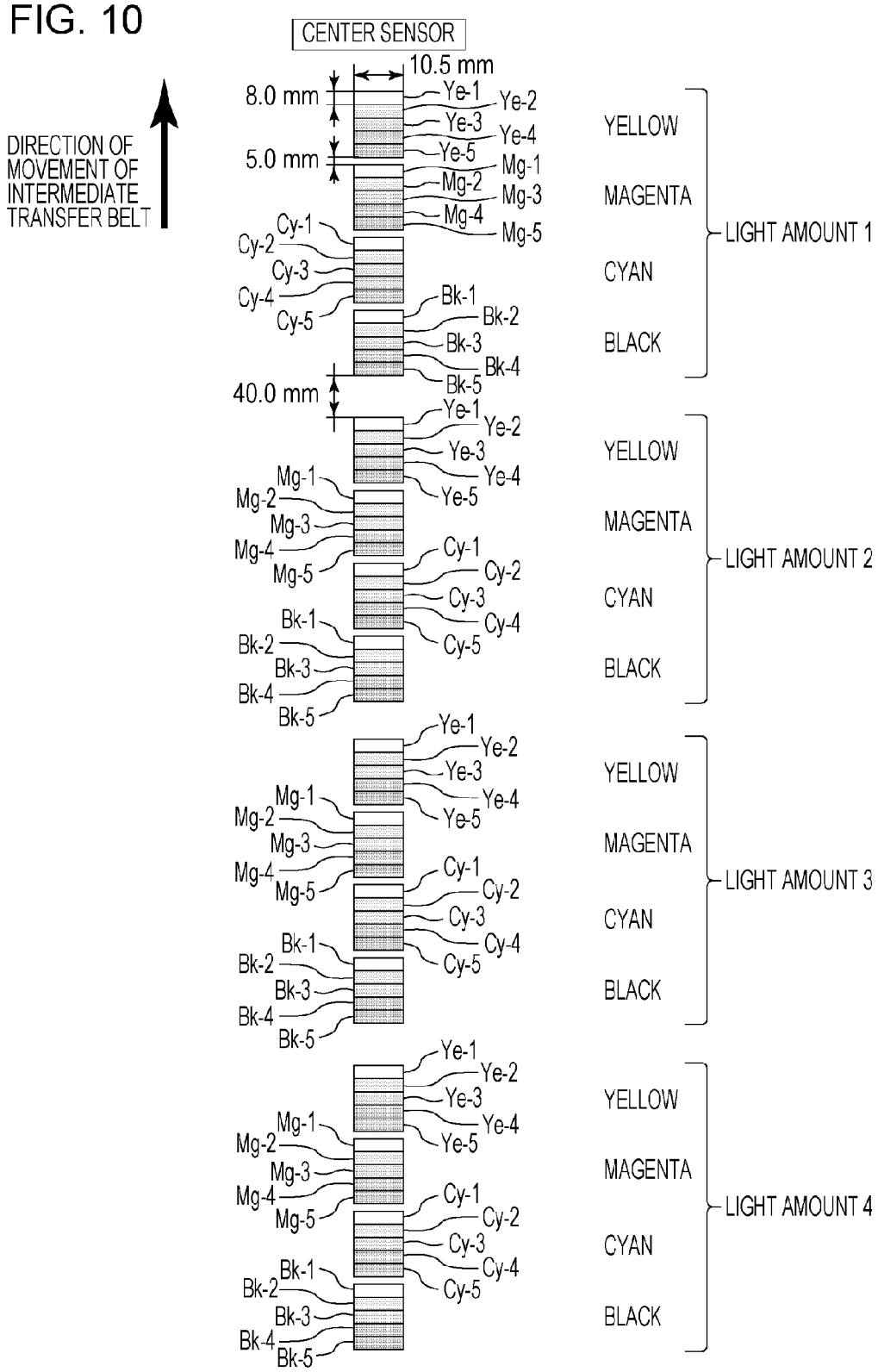
FIG. 10 is a diagram illustrating an arrangement of toner patches.

At step S101, the CPU 1312 forms a toner patch for adjusting the maximum exposure amount on the intermediate transfer belt 1. The toner patch is formed within the detectable range of the center sensor. The laser exposure unit 13 performs exposure for forming a pattern of 5 gradations for each color Y, M, C, and Bk corresponding to each exposure while changing the maximum exposure amount four times. FIG. 10 is a diagram illustrating a toner patch arrangement according to the present embodiment. The pattern of the 5 gradations for each color forms a pattern of uneven density levels at 10%, 25%, 50%, 75%, and 100%. For example, the pattern for yellow is formed as follows: Ye-1 is 10%, Ye-2 is 25%, Ye-3 is 50%, Ye-4 is 75%, and Ye-5 is 100%. The example given here sets four sets of maximum exposure amounts of five gradations for each color, but the present invention is not limited thusly, and so the number of maximum exposure amounts and gradations can be set as desired depending on the desired detection accuracy.

According to the present embodiment, the region for which the maximum exposure amount is changed from the multiple scanning regions is the scanning region corresponding to the detection region of the center sensor. Specifically, the maximum exposure amount is changed for seven scanning regions (approximately 10.5 mm) in the center form the 200 scanning regions divided in the main scanning direction. In this case, the maximum exposure amounts include a reference value (light amount 1), the reference value −5% (light amount 2), +5% (light amount 3), and +10% (light amount 4). In this way, instead of all regions of the main scanning direction, control is performed to adjust the light amount for a portion of the regions, which enables the time for calibration to be reduced.

Figure 11:
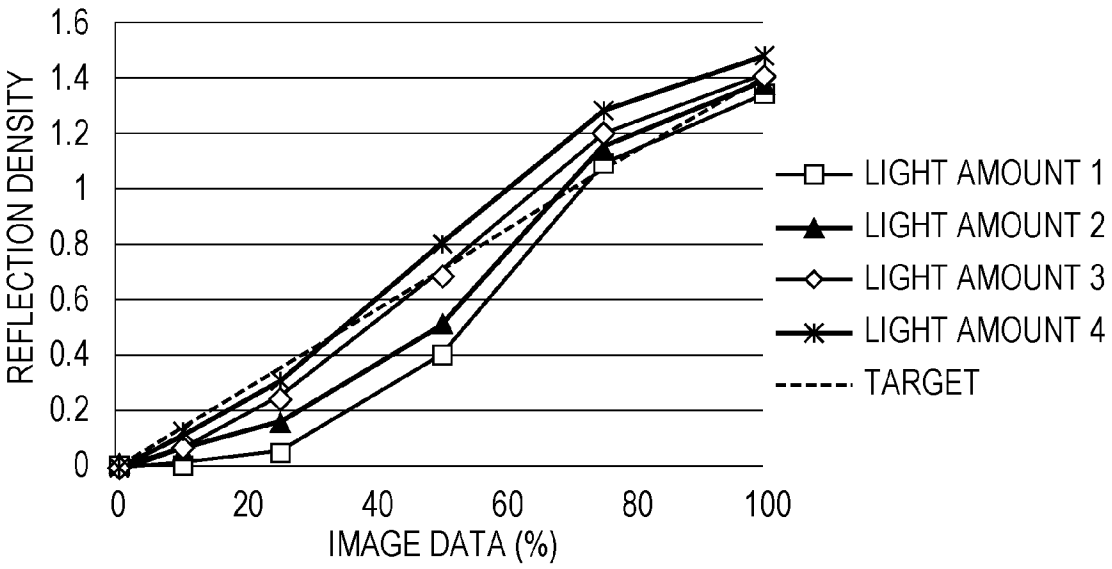
FIG. 11 is a graph illustrating detection results of detecting each toner patch.

At step S102, the CPU 1312 detects the toner patch formed on the intermediate transfer belt 1 by the center sensor. The center sensor irradiates light from the light-emitting element onto the toner patch, and sequentially detects the toner patch in accordance with the moving direction of the intermediate transfer belt 1 by receiving the light reflected from the toner patch by the light-receiving element. The detected detection result is sent to the CPU 1312 as a uneven density level signal. FIG. 11 is a graph illustrating detection results of detecting each toner patch. These are the results of calculating the uneven density levels Dc (j, p) (j=1 to 4, p=1 to 5) for each gradient of each color detected by the center sensor. It can be seen from the graph that the toner uneven density levels are different for each toner patch created by changing the maximum exposure amount.

At step S103, the CPU 1312 determines the optimum maximum exposure amount on the basis of the detection result as illustrated in FIG. 11. First, a dotted, straight line from 0% (uneven density level of 0) to 100% (uneven density level of 1.4) represents the target uneven density level line (target values). Then, the difference between the target uneven density level line and the detection result for the uneven density level of the toner patches of 5 gradients from 10 to 100% (p=1 to 5) is obtained. Then, using the following expression (2), the maximum exposure amount which minimizes the sum of the difference between the detected result of each toner patch and the target uneven density level line is selected. That is to say, when the uneven density level detection result from the sensor is designated as Dc (j, p), and the target uneven density level is designated as Dt (j, p), the maximum exposure amount that minimizes a differential sum C (j) is selected.

$$C(j)=\Sigma_{p=1}^{5}(|Dc(j,p)-Dt(j,p)|) \quad (2)$$

Obtaining the C (j) from the detection results in FIG. 11 using expression (2) results in selecting the light amount 3 (reference value+5%) for the maximum exposure amount to minimize C (j).

At step S104, CPU 1312 calculates the ratio of the maximum exposure amount before and after detecting the toner patches. As the appropriate maximum exposure amount has been determined at step S103 to be the light amount 3, the ratio corresponding to the reference value of the maximum exposure amount is 1.05 (reference value +5%).

At step S105, the CPU 1312 adjusts the maximum exposure amount for all scanning regions in the main scanning direction by multiplying the maximum exposure amount before the adjustment using toner patches with the ratio calculated at step S104. In this way, the maximum exposure amount is first changed for the regions detected by the center sensor, and after determining the appropriate maximum exposure amount, the correction value for adjusting the maximum exposure amount for other scanning regions besides the regions detected by the center sensor is calculated. As a result, the scanning regions needing an adjustment of the maximum exposure amount are suitably selected, and as the scanning regions for which the maximum exposure amount is actually changed can be determined, the downtime for calibration can be reduced. In addition, the target uneven density level can be set to a predetermined value for each halftone for each image data.

Time Required to Adjust the Maximum Exposure Amount Using Toner Patches

Next, the time required to adjust the maximum exposure amount using toner patches will be described. The time required to change the maximum exposure amount will be described in detail. According to the configuration of the present embodiment, the clock frequency for serial communication is 500 kHz, and the processing time of the CPU 1312 is 2 msec. The number of clock cycles required for write permissions and non-permissions is 13 clock cycles each, and the number of clock cycles required for writes and reads is 29 clock cycles. When changing the maximum exposure amount for seven scanning regions (appropriately 10.5 mm) for the main scanning direction, the total write time for the scanning regions of one station is 18 msec and the total read time is 14 msec for a total of 32 msec. The light correction circuit unit 1302 is common for all stations, and so 128 msec (32 msec×4) is required to change the maximum exposure amount for all four stations.

If the processing speed to form images is 190 mm/sec, the necessary distance between each pattern for changing the maximum exposure amount for seven scanning regions for the main scanning direction is 24.3 mm. The distance for each pattern is, for example, the distance from the rear end of the pattern forming the light amount 1 to the front end of the pattern forming the light amount 2. Conversely, if changing the maximum exposure amount for all 200 scanning regions for the main scanning direction, the distance required between each pattern for changing the maximum exposure amount for four stations is 611 mm. According to the present embodiment, the distance between each pattern is set to 40.0 mm in consideration of a margin, as shown in the aforementioned FIG. 10.

The toner patches of five gradations of the maximum exposure amount for each of the four colors are formed with the length of the secondary scanning direction for one gradation pattern as 8 mm. In this case, the total distance is 2473 mm if the toner patches are formed to change the maximum exposure amount for all 200 scanning regions for the main scanning direction. Conversely, according to the present embodiment, the total distance is 820 mm if the toner patches are formed to change the maximum exposure amount for seven center scanning regions for the main scanning direction. In this way, by appropriately selecting the scanning regions for changing the maximum exposure amount, the length of the formed toner patches can be shortened. Thus, the time required for calibration can be reduced. In addition, by shortening the length of the toner patches, the number of toner patches formed on the intermediate transfer belt 1 can be increased. As a result, the accuracy in detecting the uneven density levels can be improved.

If the length of the formed toner patches exceeds the circumferential length of the intermediate transfer belt 1 (950 mm according to the present embodiment), the toner patch formed on the intermediate transfer belt 1 is cleaned once, and the remaining toner patch must be formed again. Such a case increases the time required for calibration, and so the shortening the length of the toner patches formed according to the present embodiment is effective when shortening the length of the intermediate transfer belt 1 to reduce the size of the apparatus.

Next, the method to detect the toner patches will be described. Detecting the toner patches is performed by irradiating light from the light-emitting element onto the toner patches formed on the intermediate transfer belt 1, and then receiving the reflections and deflections from the toner patches by the light-receiving element. In this case, first the result of irradiating light from the light-emitting element onto the intermediate transfer belt 1 before forming the toner patches and receiving the reflected light from the surface of the intermediate transfer belt 1 by the light-receiving element is stored in random access memory (RAM) as the reference value.

Afterwards, the amount of light reflected from the toner patches is detected, and the uneven density levels of the toner patches are calculated by obtaining the rate of reduction from the reference value. The surface of the intermediate transfer belt 1 has irregularities, and so the amount of light reflected changes depending on position. The amount of light reflected also changes with time. Thus, the uneven density levels of the toner patches are calculated on the basis of the detection result from detecting the surface of the intermediate transfer belt 1 at the same position and the detection result from detecting the toner patches. For this reason, regions of at least the same length as the length of the toner patches formed on the intermediate transfer belt 1 are detected to obtain the reference value. It is also preferable to detect the surface of the intermediate transfer belt 1 each time the toner patches are formed in order ensure that the effects of changes in the intermediate transfer belt 1 over time are accurately accounted for.

In describing the flow, the surface of the intermediate transfer belt 1 is first cleaned for one cycle. Afterwards, the surface of the intermediate transfer belt is detected for one cycle to obtain the reference value (hereinafter, also referred to as detection A). Next, the toner patches are formed on the intermediate transfer belt 1, and the toner patches are detected (hereinafter, also referred to as detection B). After performing detection A and detection B, the intermediate transfer belt 1 is cleaned once more, and this series of processes ends.

As previously described, when changing the maximum exposure amount for all 200 scanning regions for the main scanning direction, the total length of the toner patches is 2473 mm. The circumferential length of the intermediate transfer belt 1 is 950 mm, and so the toner patches fit in three cycles of the intermediate transfer belt 1. When dividing the transfer patches into 3 portions and forming these on the intermediate transfer belt 1, the aforementioned detection A and detection B has to be repeated three times. This results in a total of 8 cycles of the intermediate transfer belt 1 including the operation to clean the intermediate transfer belt 1 in between detections. The processing speed is 190 mm/sec, and so the time required for one cycle of the intermediate transfer belt 1 is 5.0 seconds. Thus, when adjusting the maximum exposure amount using toner patches and to change the maximum exposure amount for all 200 scanning regions for the main scanning direction, 40 seconds of time is required for calibration.

Conversely, according to the present embodiment, when changing the maximum exposure amount for seven scanning regions for the main scanning direction, the total length of the toner patches is 820 mm. The length of the intermediate transfer belt 1 is 950 mm, and so all toner patches can be accommodated within one cycle of the intermediate transfer belt 1. Thus, the total number of cycles of the intermediate transfer belt 1 is four including one cycle for the detection A, one cycle for the detection B, and the operation to clean the intermediate transfer belt 1 before and after the detections A and B. Thus, when adjusting the maximum exposure amount using toner patches to change the maximum exposure amount of seven scanning regions for the main scanning direction, 20 seconds is required for calibration. Thus, the downtime can be reduced by 20 seconds in comparison with changing the maximum exposure amount for all scanning regions.

In this way, by adjusting the maximum exposure amount using toner patches by appropriately selecting the scanning regions for which the maximum exposure amount is changed, the downtime required for calibration can be reduced.

Second Embodiment

According to the previously described First Embodiment, the method described adjusts the maximum exposure amount by detecting toner patches by a center sensor. According to the present embodiment, a method will be described that adjusts the maximum exposure amount by detecting toner patches by a center sensor and sensors at both ends. Detailed description of portions of the configuration that are similar to the aforementioned First Embodiment is omitted.

Figure 12:
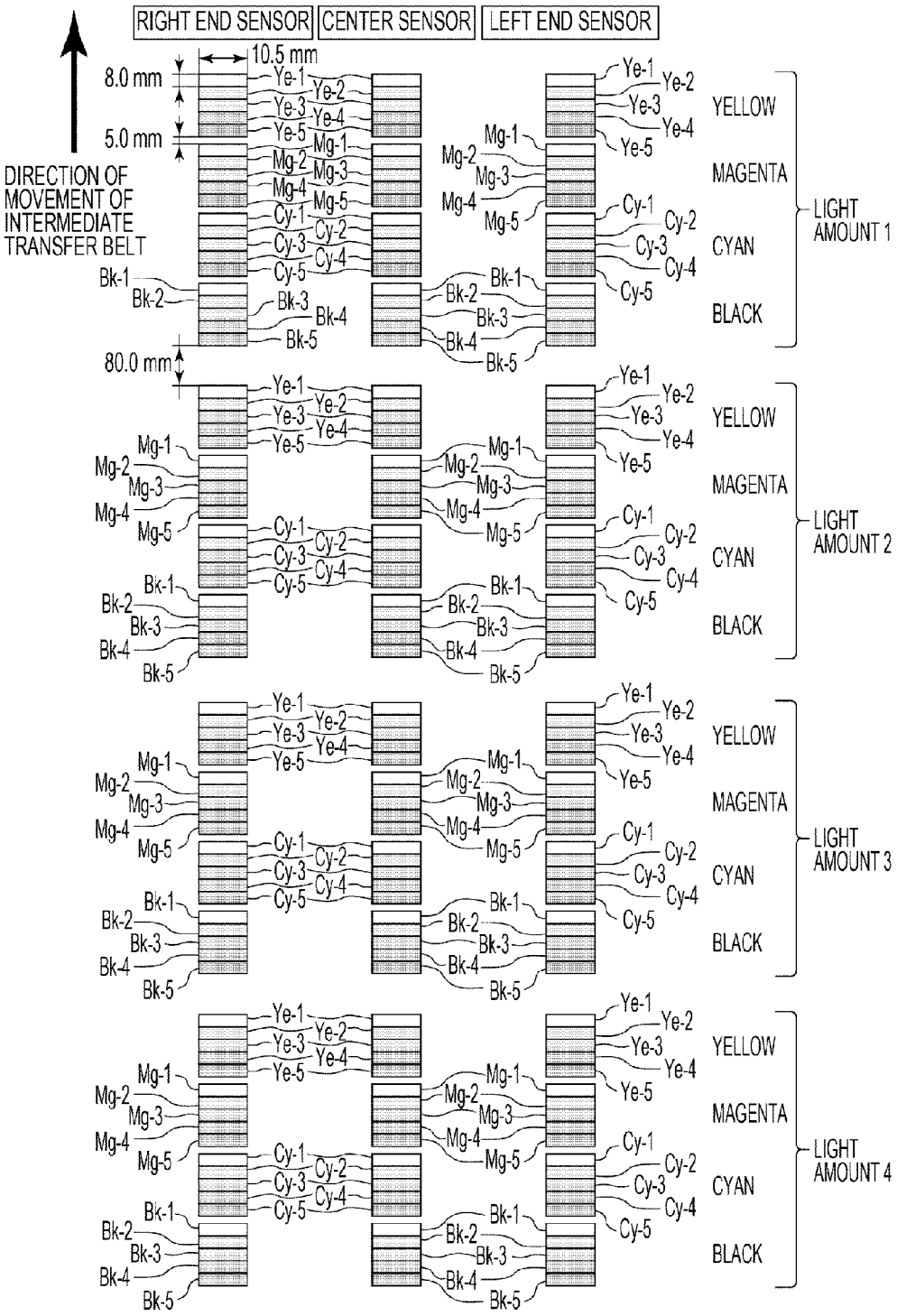
FIG. 12 is a diagram illustrating an arrangement of toner patches.

FIG. 12 is a diagram illustrating a toner patch arrangement according to the present embodiment. The specific arrangement of the sensors is similar to the aforementioned First Embodiment. According to the present embodiment, toner patches are formed in detection regions for sensors at both ends as well as the center sensor.

Figure 13:
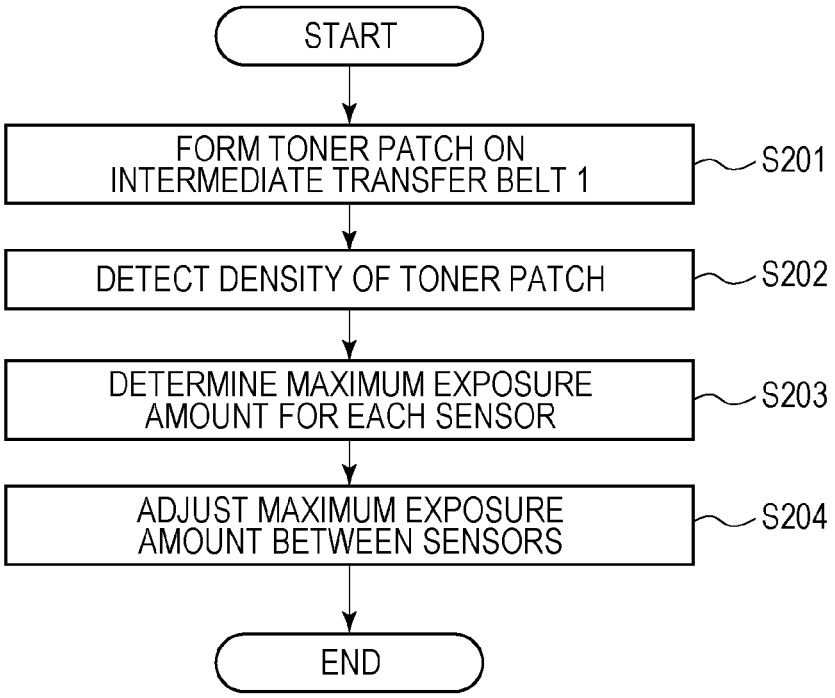
FIG. 13 is a flowchart illustrating a method to adjust the maximum exposure amount on the basis of detection results from sensors in the center and at both ends.

FIG. 13 is a flowchart illustrating a method to adjust the maximum exposure amount on the basis of detection results from sensors in the center and at both ends. In this case, the amount of light regarding the main scanning direction of the laser exposure unit 13 is measured in advance during manufacturing, and initial maximum exposure amount profile data is set with consideration for the uneven density for the main scanning direction due to the developer unit. This initial maximum exposure amount profile data is set similarly for each color and stored in the NVRAM 1314 of the light correction circuit unit 1302. The divided number of scanning regions for the main scanning direction is 200, which is the same as the aforementioned First Embodiment. The CPU 1312 adjusts the maximum exposure amount in accordance with the cumulative total number of images formed, instructions from the host computer or user, and so on.

At step S201, the CPU 1312 reads the developer voltage for each color from read only memory (ROM) to adjust the maximum exposure amount. Afterwards, the CPU 1312 starts the initial operation of the image forming apparatus main unit while also charging the photosensitive drum with a predetermined charge bias. Next, the CPU 1312 forms toner patches on the intermediate transfer belt 1 for adjusting the maximum exposure amount. The toner patches are formed in sensor detection regions for the center sensor and the sensors at both ends such that they are detectable by the center sensor and the sensors at both ends. That is to say, the seven scanning regions for the main scanning direction are formed for each sensor for a total of 21 scanning regions formed with toner patches for changing the maximum exposure amount.

After forming the toner patches, at step S202, the CPU 1312 detects the toner patches by each sensor. The detection method of toner patches is the same as that for the First Embodiment described above, so detailed description is omitted here. The CPU 1312 stores the result detected by each sensor in the RAM. Specifically, the detection results for each color from the right edge sensor DRY, DRM, DRC, and DRBk, the detection results for each color from the left edge sensor DLY, DLM, DLC, and DLBk, and the detection results from the center sensor DCY, DCM, DCC, and DCBk are stored. The detections results for the right edge sensor are DRYi, DRMi, DRCi, and DRBki (light amount level i=1 to 4). The detections results for the left edge sensor are DLYk, DLMk, DLCk, and DLBkk (light amount level k=1 to 4). The detections results for the center sensor are DCYj, DCMj, DCCj, and DCBkj (light amount level j=1 to 4).

Similar to the First Embodiment described above, the toner patches are formed while changing the maximum exposure amount, and the toner patches formed on the intermediate transfer belt 1 are cleaned after detecting the toner patches. The changed maximum exposure amount is similar to that of the First Embodiment. The CPU 1312 determines the optimum maximum exposure amount on the basis of the toner patch detection results stored in the RAM.

At step S203, the CPU 1312 compares the uneven density levels on the basis of the detection results stored in the RAM. The detection results are the detection results for the right edge sensor DRYi, DRMi, DRCi, and DRBki, the detection results for the left edge sensor DLYi, DLMi, DLCi, and DLBki, and the detection results for the center sensor DcYi, DcMi, DcCi, and DcBki. According to the present embodiment, the combination with the highest uniformity of uneven density levels over the aforementioned 5 levels of gradation (p=1 to 5) is selected from the total combinations (64) of the maximum exposure amount, which are the 4 reference levels (i, j, k=1 to 4) grouped with the detection results for each sensor for each gradation. That is to say, the combination in which the detection result is the most uniform is selected. The following expression (3) is used to select the i, j, and k that minimizes C (i, j, k).

$$C(i,j,k)=\Sigma_{p=1}^{5}(\mathrm{Max}(Dr(i,p),Dc(j,p),DL(k,p)-\mathrm{Min}(Dr(i,p),Dc(j,p,),DL(k,p)) \quad (3)$$

At step S204, the CPU 1312 calculates the maximum exposure amount for each sensor on the basis of the results obtained at step S203. The maximum exposure amount for each sensor can be interpolated linearly. As previously described for the First Embodiment, when including initial values from the light amount correction profile for the main scanning direction, the light amount correction profile can be corrected. It is not absolutely necessary to use the amount of light forming the toner patches as it is for the maximum exposure amount, in which case the maximum exposure amount can be calculated by regression analysis or similar based on the toner patch detection results. Chromaticity dE76 can also be used as a parameter for adjusting the maximum exposure amount. If there is a gradation range desired to be emphasized with correction, the maximum exposure amount can be calculated by applying a weighted coefficient to the detection results. According to the aforementioned First Embodiment, using such a light amount profile correction resulted in a maximum left and right difference in uneven density levels of 0.2 for an A4-landscape plain paper sheet. According to the present embodiment, this left and right difference in uneven density levels is further reduced to a maximum of 0.1.

Time Required to Adjust the Maximum Exposure Amount Using Toner Patches

The time required to adjust the maximum exposure amount using toner patches according to the present embodiment will be described. The time required to change the maximum exposure amount for each scanning region is the same as that for the First Embodiment. According to the previously described First Embodiment, the toner patches are formed to change the maximum exposure amount for the detection region of the center sensor. According to the present embodiment, the toner patches are formed to change the maximum exposure amount for the detection regions for the center sensor at the sensors at both ends, which results in 384 msec of time needed to switch the light amount. The distance between patterns needs to be 73.0 mm. According to the present embodiment, the distance between each pattern for switching the light amount is set to 80 mm. This results in a total distance of 940 mm to form all toner patches, and so the total length of the toner patches can be accommodated within one cycle of the intermediate transfer belt. Thus, the time required to adjust the maximum exposure amount is 20 sec, which is the same as for the First Embodiment.

Conversely, if changing the maximum exposure amount for all 200 scanning regions for the main scanning direction, 40 seconds is required, which is the same as for the First Embodiment described earlier. In this way, the downtime can be reduced by 20 seconds when adjusting the maximum exposure amount using toner patches according to the present embodiment as well. As the number of sensors used to detect toner patches increases, the accuracy in adjusting the uneven density can be improved.

In this way, by adjusting the maximum exposure amount using toner patches by appropriately selecting the scanning regions for which the maximum exposure amount is changed, the downtime required for calibration can be reduced. More accurate adjustments can be made by adjusting the maximum exposure amount on the basis of the toner patch results detected by multiple sensors.

Application Example

According the previously described embodiments, the maximum exposure amount from forming toner patches is used for adjustments, but the optimum maximum exposure amount can also be calculated from the toner patch detection results and the maximum exposure amount used when forming the toner patches. The method to adjust the maximum exposure amount has been described regarding an example in which the developer power source is common, but this method can be applied to cases in which the developer power supply is independent. The example given has sensors positioned at the center and at both ends, but the sensor positions are not limited to only the center and both ends, and it is sufficient for different positions on the main scanning direction of the intermediate transfer belt 1 to be detectable.

Variances in configurations and manufacturing of the laser exposure unit 13 are also causes of differences in uneven density levels and uneven density. For example, well-known methods for the laser exposure unit 13 include the under-field scan (UFS) method and the over-field scan (OFS) method. The OFS method in which the polygon mirror is relatively small is advantageous for high-speed, high-definition image forming apparatuses with regard to drawing speed. Conversely, with the OFS method, the length of the deflecting surface in the scanning direction is shorter for the polygon mirror in comparison with the width of the incident light beam, and so only a portion of the light beam width incident onto the polygon mirror is reflected. Thus, with the OFS method, the width of the light beam reflected by the incident angle of the beam changes, which causes the amount of light over the photosensitive drum 11 to be uneven in the longitudinal direction. That is to say, differences in the amount of light on the photosensitive drum 11 occur depending on the angle of the deflecting surface regarding the emitted laser light beam resulting in a light amount distribution in which the amount in the center is significant and the amount at both ends in the longitudinal direction is small.

A light amount correction profile to eliminate this kind of light amount distribution caused by the laser exposure unit 13 is created and added to the light amount correction profile to correct for causes by the developer unit. As a result, uneven density caused by the laser exposure unit 13 and uneven density caused by the developer unit can be treated and improved as a single problem. Problems with the light amount distribution caused by the laser exposure unit 13 are also due to variances in optical components instead of the UFS or OFS method. Thus, a number of profiles measuring the amount of laser light for the photosensitive drum 11 in the longitudinal direction at a predetermined amount of light can be created for each laser exposure unit during manufacturing, and then an exposure amount correction profile to eliminate unevenness in the light amount can be created.

The number of scanning region divisions is not limited to 200, and so this can be set to any desired number of divisions. Toner patches have been described as formed by changing the maximum exposure amount for seven scanning regions, but the number of regions for changing the maximum exposure amount can be set as desired as long as the regions are at least the width of the formed toner patches.

In addition, the length of the toner patches has been described so as to accommodated within one cycle of the intermediate transfer belt 1, but the length does not absolutely have to be less than one cycle. The advantage of reducing the downtime can still be obtained by appropriately selecting the regions to change the maximum exposure amount even if the length of the toner patches is longer than one cycle.

According to the configuration of the present invention, the downtime required for calibration to adjust the maximum exposure amount for the main scanning direction can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-137039, filed Jun. 28, 2013, which is hereby incorporated by reference herein in its entirety.

What is claimed is:

1. An image forming apparatus comprising:

an image bearing member;

a correction unit that corrects an amount of light for at least one portion of scanning positions along a main scanning direction;

an exposure unit configured to form electrostatic latent images by irradiating light on the image bearing member based on the amount of light corrected by the correction unit, the light including a first light amount and a second light amount;

a forming unit configured to form (i) a first toner patch with the first light amount and (ii) a second toner patch with the second light amount, the first and second toner patches being formed on the image bearing member on the basis of the electrostatic latent images formed by the exposure unit;

a detection unit configured to detect (i) a density of the first toner patch and (ii) a density of the second toner patch; and a control unit configured to change at least one setting of the correction unit based on the detection results by the detection unit, the at least one setting being for correcting the amount of light for each scanning position along the main scanning direction, wherein the control unit controls the correction unit to change a part of the at least one setting before a latent image corresponding to the second toner patch is formed, the part of the at least one setting being less than all of the at least one setting and the part of the at least one setting corresponding to at least a position for the second toner patch.

2. The image forming apparatus according to claim 1, wherein the at least one portion of the scanning positions, rather than all the scanning positions, in the main scanning direction, correspond to detection regions for the detection unit.

3. The image forming apparatus according to claim 2, wherein the control unit changes a maximum exposure amount of the exposure unit to be the same as a maximum exposure amount of the exposure unit when forming a toner patch having detection results closest to a target value, selected from a plurality of detection results detected by the detection unit.

4. The image forming apparatus according to claim 1, wherein the control unit changes a maximum exposure amount of the exposure unit to be the same as a maximum exposure amount of the exposure unit when forming a toner patch having detection results closest to a target value, selected from a plurality of detection results detected by the detection unit.

5. The image forming apparatus according to claim 4, wherein the maximum exposure amount is a light amount for forming a toner patch at a density level of 100%.

6. The image forming apparatus according to claim 1, wherein a density level of the first toner patch formed according to a first maximum exposure amount and a density level of the second toner patch formed according to second maximum exposure amount that is different from the first maximum exposure amount, are different.

7. The image forming apparatus according to claim 1, wherein, after the first toner patch is formed according first maximum exposure amount, the control unit performs a change from the first maximum exposure amount to a second maximum exposure amount and forms the second toner patch according to the second maximum exposure amount.

8. The image forming apparatus according to claim 1, wherein the control unit divides the main scanning direction into a plurality of regions and adjusts the amount of light corresponding to each of the plurality of regions.

9. The image forming apparatus according to claim 1, wherein the changing of the part of the at least one setting includes changing one or more settings in a correction profile.

10. The image forming apparatus according to claim 1, wherein, after the part of the at least one setting is changed, the control unit controls the correction unit to change at least an additional setting or settings along the main scanning direction.

11. The image forming apparatus according to claim 1, wherein the correction of the amount of light by the correction unit represents a correction of current supplied to the exposure unit.

12. The image forming apparatus according to claim 1, wherein the first and second toner patches are formed within one rotation of the image bearing member.

13. An image forming apparatus comprising:

an image bearing member;

a correction unit that corrects an amount of light for at least one portion of scanning positions along a main scanning direction;

an exposure unit configured to form electrostatic latent images by irradiating light on the image bearing member based on the amount of light corrected by the correction unit, the light including at least a first light amount and a second light amount;

a forming unit configured to form a plurality of toner patches, including at least a first toner patch formed with the first light amount and a second toner patch formed with the second light amount, on the image bearing member on the basis of the electrostatic latent images formed by the exposure unit;

a plurality of detection units configured to detect the densities of the plurality of toner patches; and a control unit configured to change at least one setting of the correction unit based on the detection results by the plurality of detection units, the at least one setting being for correcting the amount of light for each scanning position along the main scanning direction, wherein the control unit controls the correction unit to change a part of the at least one setting before a latent image corresponding to the second toner patch is formed, the part of the at least one setting being less than all of the at least one setting and the part of the at least one setting corresponding to at least a position for the second toner patch.

14. The image forming apparatus according to claim 13, wherein the control unit combines, among the detection results detected by the plurality of detection units, results of detecting the plurality of toner patches formed with the same gradient, and changes a maximum exposure amount of the exposure unit to a maximum exposure amount of the exposure unit when forming the plurality of toner patches of which combination yields detection results most uniform.

15. The image forming apparatus according to claim 13, wherein a maximum exposure amount is a light amount for forming a toner patch at a density level of 100%.

16. The image forming apparatus according to claim 13, wherein a density level of the first toner patch formed according to a first maximum exposure amount and a density level of the second toner patch formed according to a second maximum exposure amount that is different from the first maximum exposure amount, are different.

17. The image forming apparatus according to claim 13, wherein, after the first toner patch is formed according to a first maximum exposure amount, the control unit performs a change from the first maximum exposure amount to a second maximum exposure amount and forms the second toner patch according to the second maximum exposure amount.

18. The image forming apparatus according to claim 13, wherein the control unit divides the main scanning direction into a plurality of regions and adjusts a maximum exposure amount corresponding to each of the plurality of regions.

19. The image forming apparatus according to claim 13, wherein the changing of the part of the at least one setting includes changing one or more settings in a correction profile.

20. The image forming apparatus according to claim 13, wherein, after the part of the at least one setting is changed, the control unit controls the correction unit to change at least an additional setting or settings along the main scanning direction.

21. An image forming apparatus comprising:

an image bearing member;

a correction unit that corrects an amount of light for at least one portion of scanning positions along a main scanning direction;

an exposure unit configured to form electrostatic latent images by irradiating light on the image bearing member based on the amount of light corrected by the correction unit, the light including a first light amount and a second light amount;

a forming unit configured to form a plurality of toner patches, including at least a first toner patch formed with the first light amount and a second toner patch formed with the second light amount, on the image bearing member on the basis of the electrostatic latent images formed by the exposure unit;

a detection unit configured to detect the densities of the first toner patch and the second toner patch; and a control unit configured to change at least one setting of the correction unit based on the detection results by the detection unit, the at least one setting being for correcting the amount of light for each scanning position along the main scanning direction, wherein, after forming the first and second toner patches by controlling the correction unit to change a part of the at least one setting after a latent image corresponding to the first toner patch is formed and before a latent image corresponding to the second toner patch is formed, the part of the at least one setting being less than all of the at least one setting and the part of the at least one setting corresponding to at least a position for the second toner patch, the control unit controls the correction unit to change at least an additional setting or settings along the main scanning direction based on detection results by the detection unit.

22. The image forming apparatus according to claim 21, wherein the changing of the part of the at least one setting includes changing one or more settings in a correction profile.

* * * * *